US005169143A

United States Patent [19]

Chung et al.

[11] Patent Number: 5,169,143

[45] Date of Patent: Dec. 8, 1992

[54] BIN TRAY TRANSFERRING APPARATUS OF COMPACT SORTER FOR COPY MACHINE

[75] Inventors: Jae H. Chung, Uijongbu; Yeon K. Jung, Bucheonsi, both of Rep. of Korea

[73] Assignee: Sindo Ricoh Co., Ltd., Seoul

[21] Appl. No.: 764,441

[22] Filed: Sep. 24, 1991

[30] Foreign Application Priority Data

Jul. 15, 1991 [KR] Rep. of Korea ..... 1991-12035

[51] Int. Cl.[5] ..... B65H 39/11

[52] U.S. Cl. ..... 271/293; 271/294

[58] Field of Search ..... 271/292-294

[56] References Cited

U.S. PATENT DOCUMENTS

| | | | |
|---|---|---|---|
| 4,328,963 | 5/1982 | DuBois et al. . | |
| 4,332,377 | 6/1982 | DuBois et al. . | |
| 4,343,463 | 8/1982 | Lawrence | 271/294 |
| 4,433,837 | 2/1984 | Romanowski | 271/293 |
| 4,466,608 | 8/1984 | DuBois et al. . | |
| 4,466,609 | 8/1984 | Lawrence . | |
| 4,500,087 | 2/1985 | DuBois | 271/294 |
| 4,878,660 | 11/1989 | Irie | 271/294 |
| 4,911,424 | 3/1990 | Lawrence . | |
| 5,040,782 | 8/1991 | Benedict | 271/294 |
| 5,048,820 | 9/1991 | Chung et al. | 271/294 |

FOREIGN PATENT DOCUMENTS

| | | |
|---|---|---|
| 60-232370 | 11/1985 | Japan . |
| 90-18264 | 11/1990 | Rep. of Korea . |
| 89-8291 | 1/1991 | Rep. of Korea . |
| 2168037 | 6/1986 | United Kingdom . |

OTHER PUBLICATIONS

RICOH Company photographs which show a sorter having a pair of auxiliary hooks at both side plates of the sorter, 2 sheets, each of 4 pictures (date unknown).

*Primary Examiner*—Robert P. Olszewski
*Assistant Examiner*—Steven M. Reiss
*Attorney, Agent, or Firm*—Darby & Darby

[57] ABSTRACT

A bin tray transferring apparatus of a sorter for copy machine. The apparatus comprises a safety guide 60 vertically mounted to the side plate 10, a safety lever 50 rotationally mounted to an upper inner portion of the rack 40 such that one end 52 thereof contacts with said safety guide 60 but the other end 53 thereof always contacts with an upper circumferential end of the transfer wheel 30 or a tray pin 91 of an uppermost bin tray 80, and a hinged connection for rotatably connecting the safety level 50 to the upper inner portion of the rack 40. The apparatus of this invention provides an advantage in that the pin trays can be stably transferred upwards and downwards irrespective of outside force imposed thereon so that one of the tray pins of the bin tray can be efficiently prevented from deviation, thereby accomplishing the lengthening of using life thereof and improving the operational reliability thereof.

6 Claims, 6 Drawing Sheets

BIN TRAY TRANSFERRING APPARATUS OF COMPACT SORTER FOR COPY MACHINE

BACKGROUND OF THE INVENTION

1. Field of The Invention

The present invention relates to a compact sorter for copy machine, and more particularly to a bin tray transferring apparatus of the sorter capable of preventing the bin trays each having a pair of tray pins from deviation, such as due to outside force, during upward and downward movement thereof by using the driving power of the transfer wheel.

2. Description of The Prior Art

Conventionally, a representative type of known sorter for copy machine is provided with a pair of side plates each having a slot liner extending toward the ejecting section of the copy machine and adapted to guide the movement of bin trays for receiving the separate document distributed from the ejecting section of the copy machine and a transferring member for transferring the bin trays, such as a transfer wheel mounted to the side plate near the inclined middle portion of the slot liner. Thus, the bin trays are transferred up and down one by one by rotation of the transferring member.

An example of the conventional type of tray transferring apparatus, as disclosed in U.S. Pat. Nos. 4,328,963 and 4,332,377, is provided with a wire of which one end is connected to the pin tray of the lowest bin tray, while the other end is connected to the spring disposed at the upper portion of the sorter.

There has been also proposed a known sorter using a drum cam instead of the transfer wheel. For examples, a sorter disclosed in U.S. Pat. No. 4,466,609 is provided with two drum cams and a support frame, and a sorter disclosed in United Kingdom Patent No. 2,168,037 is equipped with an auxiliary bin tray supporter having the same shape as that of the slot liner so that the bin tray can move vertically upwards and downwards upon providing a simultaneous moving of the inner portion of the bin tray, that is a pin tray side, and the outer portion thereof, that is a tap side.

Also, as disclosed in Japanese Patent laid-open publication No. sho 60-232370, a transferring apparatus capable of using support frame in the construction of using the transfer wheel has been proposed. Such type of transferring apparatus have an auxiliary protrusion provided at a part of the outside of the radius of gyration of the transfer wheel and more equipments such as cams and outer springs adapted to drive the transfer wheel. Furthermore, this type of transferring apparatus has a contact surface provided at the bin tray and adapted for contacting with the pin tray during driving the transferring apparatus. The transfer wheel moves in revolution and precipitation at the same time.

Korean Patent Laid-Open Publication No. 91-371 discloses a bin tray transferring apparatus of sorter adopting a method capable of reducing the noises by changing the shape of transfer wheel to have a camming mechanism. Also, as disclosed in Korean Patent Application Nos. 90-855 and 90-16620, which were applied by this applicant, there has been proposed another type of sorter having a slot liner having an inclined middle portion extending from the upper and lower vertical portions of the slot liner toward the ejecting section of the copy machine. In this type of sorter, the bin tray can advance closer to the ejecting section of the copy machine, thereby making it possible to receive and arrange the copies without any auxiliary guiding unit.

On the other hand, the applicant of this invention has proposed a sorter having a transfer wheel provided with three slots, as disclosed in Korean Patent Application No. 90-18264. This sorter carries out a transferring operation for the bin tray during one third cycle of rotation of the transfer wheel as a result of the three slots each arranged at every 120° on the transfer wheel and extending radially inward from a circumference of said transfer wheel, and transfers slowly and upwardly another lower waiting bin tray according to the driving rate of the transfer wheel because the transfer wheel was also provided with involute portions each formed at sections which contacts with the pin tray of the bin tray so that a waiting pin tray could be smoothly and naturally located within the radius of gyration of said transfer wheel. Thus, this type of transfer wheel could be applied to various types of sorters provided with biasing units for urging the bin tray upwardly, said biasing units using a spring, a wire, a rack or a supporting mechanism.

Also, the applicant of this invention proposed another type of bin tray transferring apparatus of a sorter as disclosed in Korean Patent Application No. 91-4036. This type of apparatus is invented for solving a disadvantage of the transfer wheel of the above-mentioned Korean Patent Application No. 90-18264, generation of considerable noise. Therefore, this apparatus is provided with a pair of side plates, first and second transfer wheels each mounted to each said plate, first and second slot liners formed on opposite side plates of the sorter and each having at a portion thereof within the radius of gyration of the transfer wheel an inclined middle portion extending toward an ejecting section of the copy machine. The apparatus also has a pair of racks each engaging with a rack driving member and having a lower portion fixedly connected to the pin tray of a lowest positioned bin tray. In addition, the transfer wheel includes three radial slots, normally formed rounded portions each formed between two slots and having two passages, said passage formed at a surface with which the pin tray of the bin tray contacts. Thus, simultaneously with transferring the bin trays one by one by means of the rotational power of the transfer wheel the apparatus drives the racks to move upwards and downwards so as to cause the whole bin trays to move upwards and downwards. However, almost the known sorters having the conventional bin transferring apparatus has disadvantage in that the bin tray transferring apparatus is provided with no device for preventing the bin trays from deviation during upward and downward movement thereof along the slot liners of the side plates, thereby causing the bin trays to deviate from the sorter such as to outside force. In an effort for solving the above-mentioned disadvantage, some of known sorters include a bin tray transferring apparatus provided with an auxiliary weight bar mounted at the upper portion of the sorter so as to simply weighting the tray pins of bin trays downwards by means of its own weight. However, this type of bin tray transferring apparatus has a considerable weight, resulting in increasing the load imposed on the bin tray as the bin tray is transferred upwards by the transferring apparatus. Also, the weight bar has a simple construction for providing the downward weighting function thereof for the bin trays, so that it has no device for preventing the pin tray of the bin tray from ascending in the slot liner due to an outside force imposed on the bin tray. Thus, this type of weight bar has a disadvantage in that one of the opposite tray pins of the bin tray in movement often ascends in the slot liner due to the outside force so that the transfer wheel picks up only one pin tray disposed in its place, while the other pin tray, ascending pin tray, can not be picked up by the transfer wheel, thereby causing a trouble of the sorter.

In an effort for solving the above disadvantage of weight bar, a sorter provided with another type of weight bar has been proposed by the RICOH company. This type of sorter is provided with a pair of auxiliary hooks provided at the side plates, respectively, each hook upwardly disposed between the lift shaft provided at the lower end of the rack and a shaft provided at the upper portion of the uppermost bin tray and adapted for supporting the bin trays so as to prevent the bin tray from deviation. However, this type of sorter must be provided, at a vertical supporting distance by means of the hook, with a vertical space taking account of a thick of a plurality of copies (about 100 copies) which is to be received by the uppermost bin tray, so that the hook can not sufficiently weight the tray pins downwards due to the space taking account of the thick of the copies. Hence, this type of sorter only prevents the deviation of the bin trays from slot liner of the sorter, but it can not solve the above-mentioned disadvantage of the weight bar. Furthermore, this sorter has to be provided at the opposite upper portions of the sorter with a pair of auxiliary shafts for supporting the upper end of the hooks.

SUMMARY OF THE INVENTION

It is, therefore, an object of this invention to provide a bin tray transferring apparatus of a sorter for copy machine in which the above-mentioned disadvantages can be overcome and the bin trays are not separated from the sorter at any case, thereby usually providing a safety transferring operation for the bin trays.

The above-mentioned object of this invention can be accomplished by providing a bin tray transferring apparatus of a sorter for copy machine comprising a pair of side plates disposed at opposite sides, respectively, a slot liner formed at each said side plate and having an upper vertical portion, a lower vertical portion and an inclined middle portion extending toward an ejecting section of said copy machine, a pair of transfer wheels each rotatably mounted to each said side plate such that said inclined middle portion of said slot liner overlaps with a radius of gyration of said transfer wheel, said transfer wheel provided with three radial slots and normally formed rounded portions each formed between two slots and having two passages, a power transmitting device for providing rotational power to said opposite transfer wheels, a pair of racks each movably mounted to said side plate and adapted for transferring said bin trays upwards and downwards by means of the rotational power of said transfer wheel, the bin tray transferring apparatus further comprising: a safety guide vertically mounted to each said side plate; a safety lever rotatably mounted to an upper inner portion of each said rack such that one end thereof contacts with said safety guide but the other end thereof always contacts with an upper circumferential end of said transfer wheel or a tray pin of an uppermost bin tray; and means for rotatably connecting said safety lever to said upper inner portion of said rack; wherein said bin trays are always transferred upwards and downwards without deviation from said slot liners.

BRIEF DESCRIPTION OF THE DRAWINGS

The above and other objects, features and other advantages of the present invention will be more clearly understood from the following detailed description taken in conjunction with the accompanying drawings, in which:

FIGS. 2A to 2D are views showing detailed construction of a safety lever and a rack each provided at the bin tray transferring apparatus of FIG. 1, in which:

FIG. 2A is a perspective view of the safety lever and the rack before assembling;

FIG. 2B is a side view after assembling; and

FIG. 2C and 2D are sectioned views taken along the line A—A' of FIG. 2B, respectively, but showing embodiments of a hinged connection between the safety lever and the hinge pin of the rack, different from each other;

FIGS. 3A to 3D are views showing operating states of the bin tray transferring apparatus of FIG. 1, in which:

FIG. 3A is a side view showing an initial state in that the whole bin trays are disposed under the transfer wheel;

FIG. 3B is a side view showing a state in that the transfer wheel rotates in $\frac{2}{3}$ revolution, that is two steps, from the initial state of FIG. 3A; and FIG. 3C is a side view showing a state in that the transfer wheel rotates in a revolution, that is three steps, from the state of FIG. 3B.

DETAILED DESCRIPTION OF PREFERRED EMBODIMENTS

Figure 1:
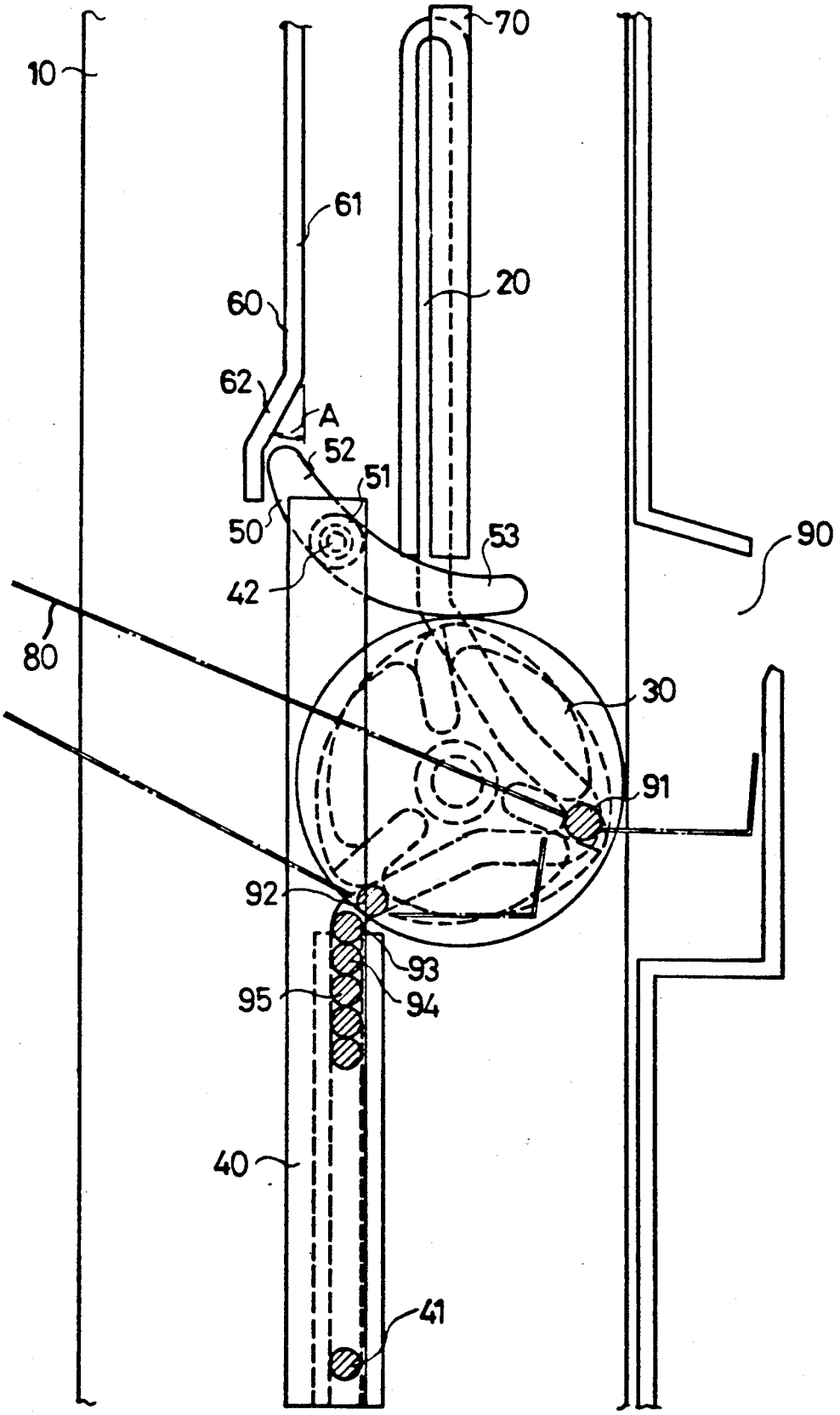
FIG. 1 is a schematic side view of a bin tray transferring apparatus of a compact sorter in accordance with the present invention.

Referring now to FIG. 1 which is a schematic side view of an embodiment of a bin tray transferring apparatus of a compact sorter in accordance with the present invention. The apparatus is provided with a pair of side plates 10 disposed at opposite sides of the sorter, respectively. Each side plate 10 has a slot liner 20 including an upper vertical portion, a lower vertical portion and an inclined middle portion extending toward an ejecting section 90 of the copy machine. A pair of transfer wheels 30 each is mounted to the side plate 10 so as to result in overlapping the radius of gyration thereof with the inclined middle portion of the slot liner 20.

The transfer wheel 30 is provided with three slots radially formed, each normally formed as rounded at its opposite outer guides so that the wheels 30 each picks up each pin tray of the bin tray by means of the slot as it rotates by virtue of a driving power supplied by a conventional driving member (not shown), thereby causing the bin trays to be transferred upwards and downwards one by one. Also, a pair of racks 40 are movably mounted to the side plates 10 such that each rack 40 engages with the transfer wheel 30, thereby moving upwards and downwards in accordance with the rotation of the transfer wheel 30. Also, the racks 40 allow opposite ends of a lift shaft 41 to insert into the lowermost ends of vertical holes thereof so that the rack 40 drives the whole bin trays to move up and down in a driving rate corresponding to the rotating speed of the transfer wheel 30. In addition, each rack 40 is provided with a hinge shaft 42 mounted on an upper portion of said rack 40 as projecting inwardly. A safety lever 50 is rotationally mounted to the hinge shaft 42, and a safety guide 60 is vertically mounted to an upper portion of each side plate 10.

On the other hand, the side plate 10 is provided with a vertical supporter 70 vertically mounted to the upper portion of the side plate 10 near the upper vertical portion of the slot liner 20 in order to prevent the safety lever 50 from deviation while the safety lever 50 turns upwards and downwards. The vertical supporter 70 is mounted to the side plate 10 with a space with respect to the side plate 10 taking account of projecting length of the hinge pin 42 of the rack 40.

In addition, the safety guide 60 comprises two parts, a vertical part 61 and an inclined part 62, said inclined part 62 having an angle of inclination A with respect to the vertical axial. The angle of inclination A is determined by a radius of curvature and a size of the safety lever 50 determined taking account of a diameter of each tray pin 91, 92, 93, 94, 95 and a moving rate of the rack 40, that is a moving distance of the rack 40 during $\frac{1}{3}$ rotation of the transfer wheel 30, that is one step of the transfer wheel 30. It is desired to determine the angle of inclination A within 45° degree in order to facilitate the upward movement of the bin trays.

Figure 2A:
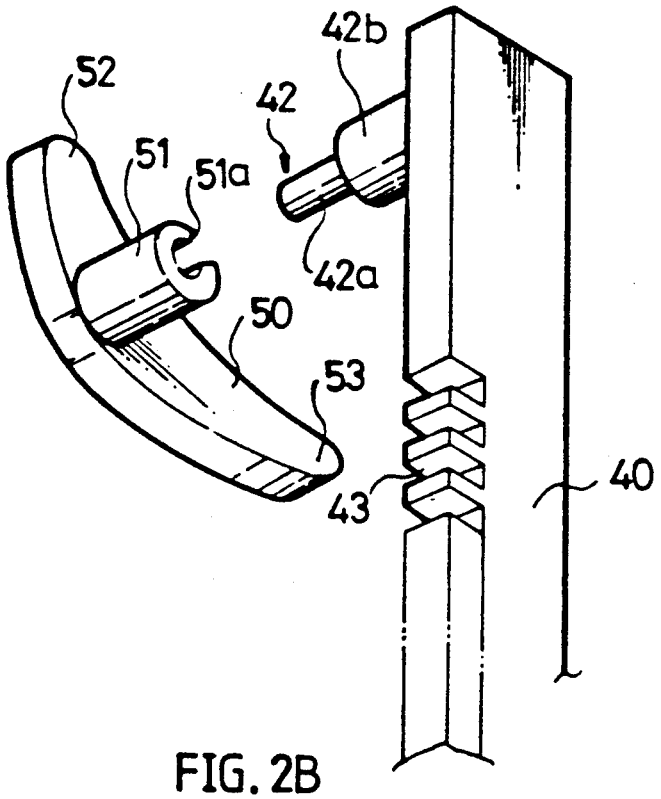
Figure 2B:
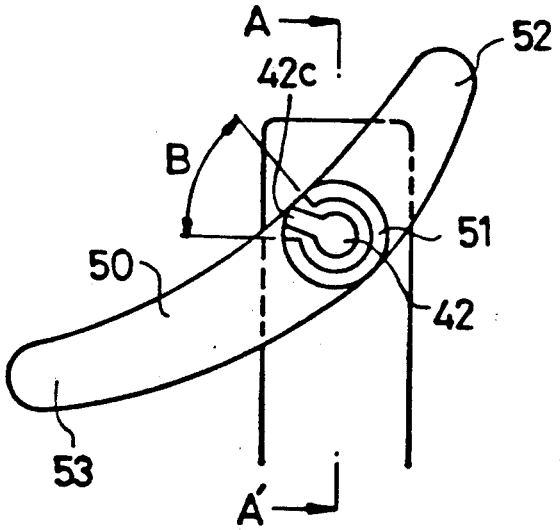
Figure 2C:
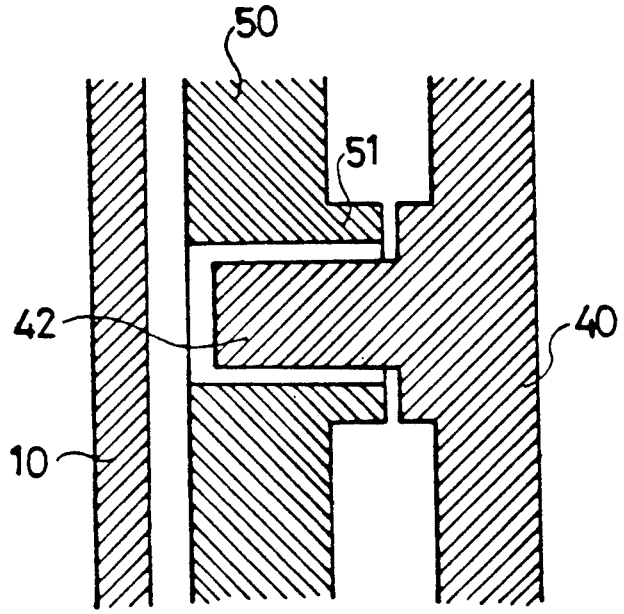
Figure 2D:
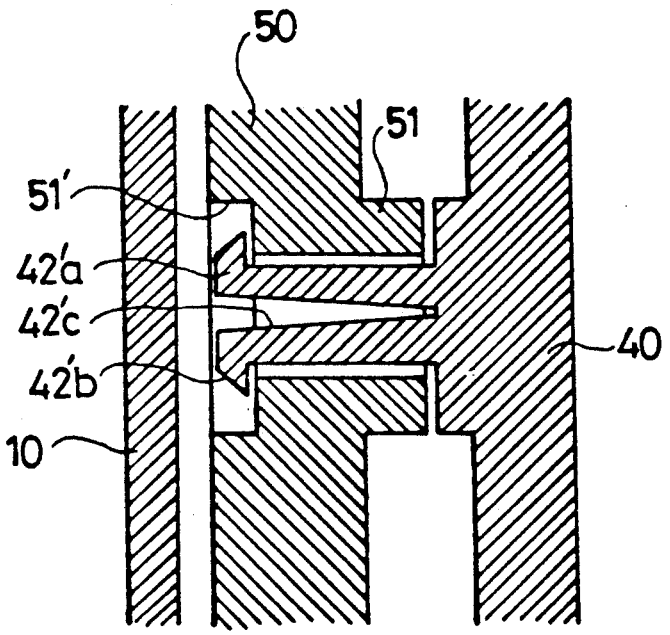

Turning next to FIGS. 2A to 2D which are views showing detailed construction of the safety lever 50 and the rack 40, FIG. 2A is an exploded perspective view of the safety lever 50 and the rack 40, FIG. 2B is a side view thereof after assembling, FIG. 2C and 2D are sectioned views thereof taken along the line A—A" of FIG. 2B, respectively, but showing embodiments of a hinged connection between the safety lever 50 and the pin 42 of the rack 40 different from each other.

As shown in the drawings, the hinge pin 42 projects from the upper portion of the rack 40 as integrally formed therewith and comprises two parts, a relatively smaller diameter end part **42*a* and a relatively larger diameter part 42*b*. The safety lever 50 has a cylindrical boss 51 which is inserted onto the relatively smaller end part 42*a* of the hinge pin 42 in order to provide rotation for the lever 50, a guide contact end 52 integrally projecting from the cylindrical boss 51 and adapted for contacting with the inclined portion 62 of the safety guide 60 and a pin contact end 53 integrally projecting from the cylindrical boss 51 in a direction opposite to the guide contact end 52. The ends 52 and 53 of the lever 50 are gently curved in order to have a radius of curvature, while the pin contact end 53 is relatively longer than the other end 52. In addition, the radius of curvature of the pin contact end 52 is determined so that a height of a surface contacting with the upper circumferential end of the transfer wheel 30, said contacting surface of the pin contact end 53 gradually varying as the lever 50 gradually rotates, is maintained at a predetermined height while the lever 50 rotates clockwise by virtue of an upward movement of the rack 40**.

As shown in FIGS. 2A and 2B, the cylindrical boss 51 of the safety lever 50 is vertically cut in order to provide a vertical slot **51*a* having a width, while the small diameter end 42*a* of the hinge pin 42 is integrally provided with a vertical protrusion 42*c* having a relatively smaller circumferential thick than the width of the slot 51*a* of the cylindrical boss 51 of the lever 50. Thus, the safety lever 50 is efficiently prevented from rotating over a predetermined rotational angle B, thereby accomplishing the stable operation of the safety lever 50** (see FIG. 2B).

While FIG. 2C shows an embodiment of a hinged connection comprising a simple cylindrical boss 51 and a simple cylindrical hinge pin 42, FIG. 2D shows another embodiment of a hinged connection comprising the cylindrical boss 51, a depressed slot 51' formed at a side of the lever 50 opposite to the cylindrical boss 51 and a smaller diameter end **42'*a* of the hinge pin 42, said end 42'*a* having a snap flange 42'*b* and a wedge type hole 42'*c* in order to snap on the depressed slot 51'**. This another embodiment of the hinged connection shown in FIG. 2D has advantage in that it improves a stability for the hinged connection.

Figure 3A:
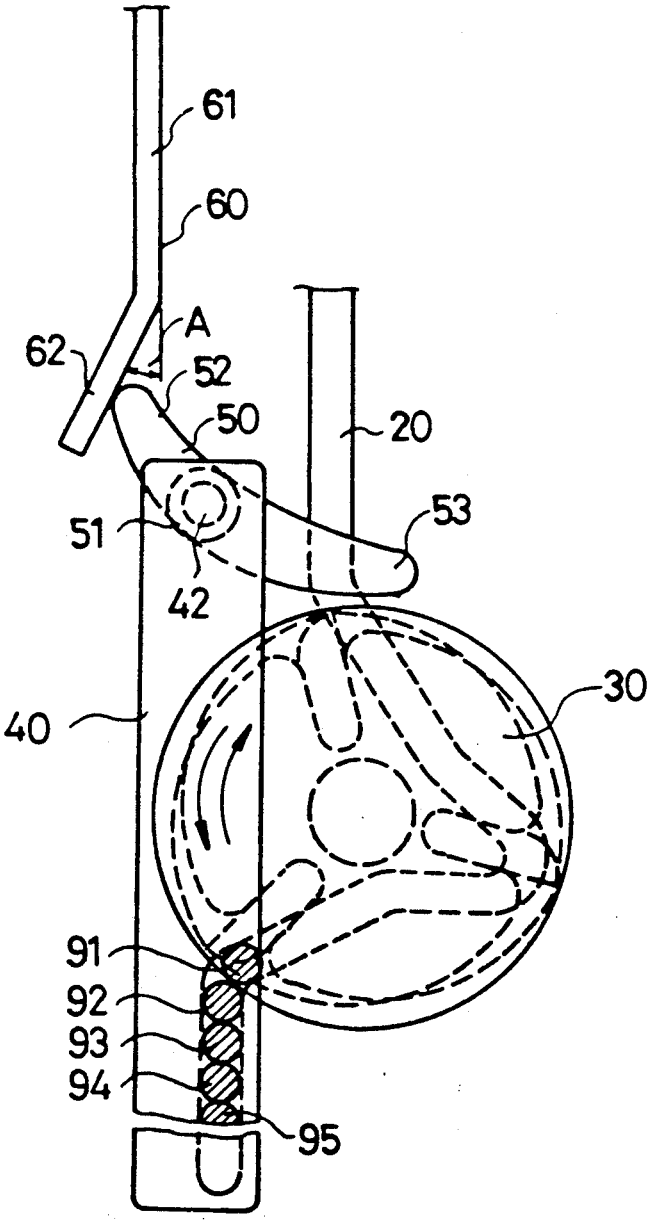

Turning next to FIGS. 3 which are side views showing respective operating states of the bin tray transferring apparatus according to this invention, FIG. 3A is a side view showing an initial state in that the whole bin trays are disposed under the transfer wheel 30.

Figure 3B:
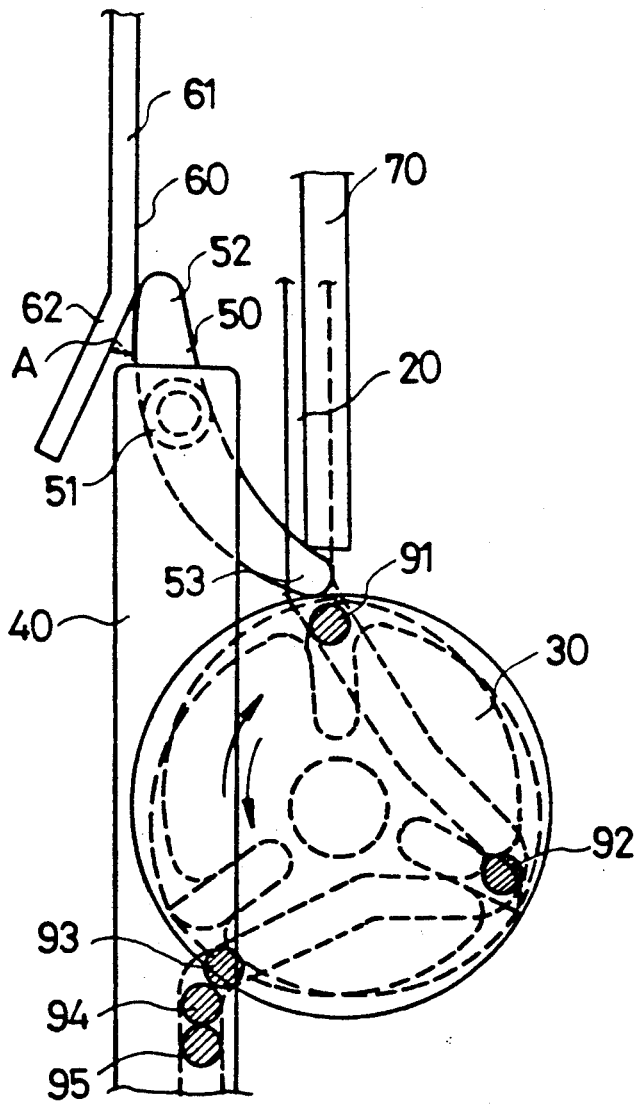

On the other hand, FIG. 3B is a side view showing a state in that the transfer wheel 30 rotates in $\frac{2}{3}$ revolution, that is two steps, from the initial state of FIG. 3A. At this time, the uppermost tray pin, the first tray pin 91 is disposed at a position wherein it is just to be distributed upwards from the radial slot of the transfer wheel 30, while the second tray pin 92 is disposed at a transferring position of the transfer wheel 30 and the third tray pin 93 is disposed at a waiting position of the lower portion of the slot liner 20. Also, the rack 40 moves upwards by the clockwise rotation of the transfer wheel 30 so that the safety lever 50 also move upwards, thereby causing the guide contact end 52 contacting with the inclined portion 62 of the safety guide 60 to rotate clockwise simultaneously with sliding along the guide surface of the inclined portion 62 of the safety guide 60. At this time, the pin contact end 53 of the safety lever 50 continuously contacts with the upper circumferential end of the transfer wheel 30 at a predetermined height without change of the height even though the rack 40 moves upwards at a moving rate resulting from the rotation of the transfer wheel 30 in order to change the vertical position thereof. Thus, the first tray pin 91 is efficiently prevented from deviation from the radial slot of the transfer wheel 30.

Figure 3C:
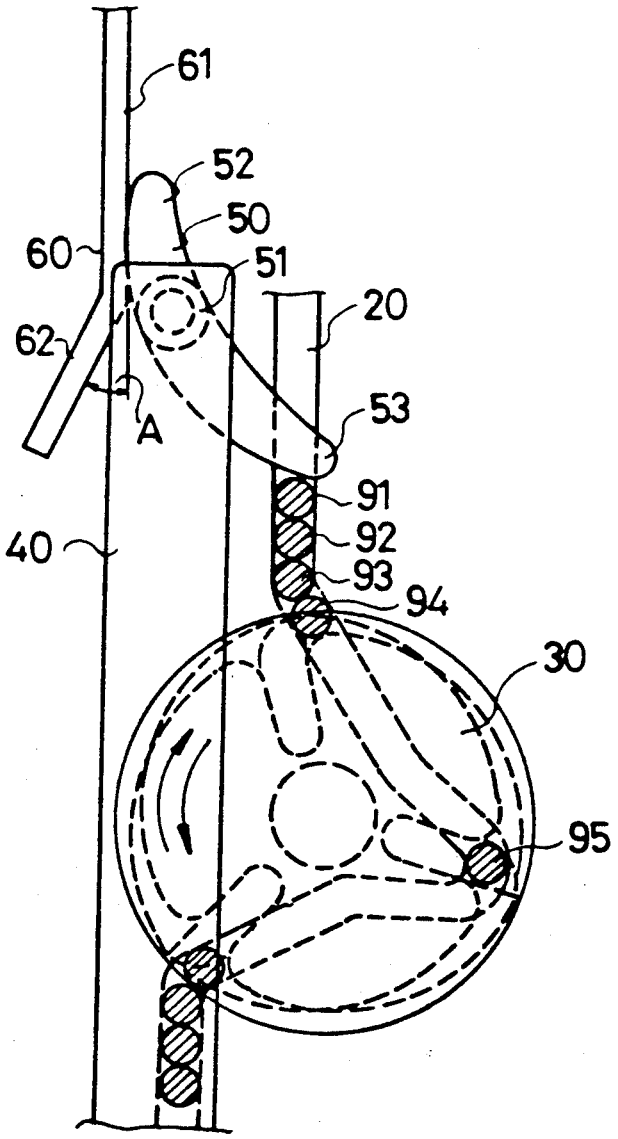

Additionally, FIG. 3C is a side view showing a state in that the transfer wheel 30 rotates in a revolution, that is three steps, from the state of FIG. 3B. At this time, the first, second and third tray pins 91 to 93 are already transferred to the upper portion of the slot liner 20 by means of the transfer wheel 30. Here, the rack 40 moves upwards by virtue of the rotation of the transfer wheel 30 so that the safety lever 40 also moves upwards. Thus, the guide contact end 52 of the lever 50 moves upwards along the guide surface of the vertical portion 61 of the safety guide 60 at a moving rate corresponding to the upward moving rate of the rack 40 so that the pin contact end 53 of the lever 50 always disposes closely near the first tray pin 91 even though the tray pin 91 moves upwards by virtue of the rotation of the transfer wheel 30. Therefore, the tray pin of the bin tray is efficiently prevented from deviation from the slot 20 of the side plate 10 such as due to an outside force, thereby causing a troubled operation of the bin tray transferring apparatus due to the deviation of the tray pin to be efficiently prevented.

As described above, the a bin tray transferring apparatus of a sorter for copy machine according to this invention provides an advantage in that the bin trays can be stably transferred upwards and downwards irrespective of outside force imposed thereon so that one of the tray pins of the bin tray can be efficiently prevented from deviation, thereby accomplishing the lengthening of using life thereof and improving the operational reliability thereof.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A bin tray transferring apparatus of a sorter for copy machine comprising a pair of side plates disposed on both sides of the sorter, respectively, a slot liner formed at each said side plate and having an upper vertical portion, a lower vertical portion and an inclined middle portion extending toward an ejecting section of said copy machine, a pair of transfer wheels each rotatably mounted to each said side plate such that said inclined middle portion of said slot liner overlaps with a radius of gyration of said transfer wheel, said transfer wheel provided a means for moving said bin trays, with a power transmitting device for providing rotational power to said opposite transfer wheels, a pair of racks each movably mounted to said side plate and adapted for transferring said bin trays upwards and downwards by means of the rotational power of said transfer wheel via said means for moving said bin trays, the bin tray transferring apparatus further comprising:

a safety guide vertically mounted to each said side plate;

a safety lever rotatably mounted to an upper inner portion of each of said racks such that one end thereof contacts with said safety guide and the other and thereof contacts with an upper circumferential end of said transfer wheel of a tray pin or an uppermost bin tray; and means for rotatably connecting said safety lever to said upper inner portion of said rack;

wherein said bin trays are always transferred upwards and downwards without deviation from said slot liners.

2. A bin tray transferring apparatus of a sorter for copy machine as claimed in claim 1, wherein said apparatus further comprises a supporter vertically mounted to an upper portion of each said side plate near said upper vertical portion of each said slot liner in order to prevent said safety lever from deviation.

3. A bin tray transferring apparatus of a sorter for copy machine as claimed in claim 1, wherein said safety guide comprises two parts for guiding upward and downward movement of said safety lever, a vertical part and an inclined part.

4. A bin tray transferring apparatus of a sorter for copy machine as claimed in claim 1, wherein said safety lever comprises:

a guide contact end movably contacting with said safety guide; and a pin contact end having a radius of curvature for maintaining a height of a surface thereof contacting with said upper circumferential end of said transfer wheel without change by virtue of rotation thereof on the basis of said means for rotatably connecting while said rack moves upwards and downwards in a distance.

5. A bin tray transferring apparatus of a sorter for copy machine as claimed in claim 1, wherein said means for rotatably connecting said safety lever to said rack comprises:

a cylindrical boss provided at said safety lever; and a hinge shaft provided at said upper inner portion of said rack as inwardly projecting therefrom.

6. A bin tray transferring apparatus of a sorter for copy machine as claimed in claim 5, wherein said cylindrical boss of said safety lever is vertically cut in order to provide a vertical slot having a width, while said hinge pin is provided with a vertical protrusion having a relatively smaller circumferential thick than said width of said slot of the cylindrical boss of the lever so that said safety lever rotates within a predetermined rotational angle.

* * * * *